US010287826B2

(12) United States Patent
Ma et al.

(10) Patent No.: US 10,287,826 B2
(45) Date of Patent: May 14, 2019

(54) SYSTEM AND METHODOLOGY FOR POWER CABLE COUPLING

(71) Applicant: Schlumberger Technology Corporation, Sugar Land, TX (US)

(72) Inventors: Patrick Zhiyuan Ma, Lawrence, KS (US); Gregory Howard Manke, Overland Park, KS (US); William Goertzen, Lawrence, KS (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 140 days.

(21) Appl. No.: 15/175,813

(22) Filed: Jun. 7, 2016

(65) Prior Publication Data

US 2017/0350198 A1 Dec. 7, 2017

(51) Int. Cl.

| | |
|---|---|
| ***H01R 4/60*** | (2006.01) |
| ***E21B 17/02*** | (2006.01) |
| ***E21B 43/12*** | (2006.01) |
| ***E21B 17/00*** | (2006.01) |
| *H01R 13/523* | (2006.01) |

(52) U.S. Cl.

CPC ..... *E21B 17/028* (2013.01); *E21B 17/00* (2013.01); *E21B 43/128* (2013.01); *H01R 13/523* (2013.01)

(58) Field of Classification Search

CPC .. H01R 13/523; H01R 13/5205; E21B 33/043
See application file for complete search history.

(56) References Cited

U.S. PATENT DOCUMENTS

| | | | | |
|---|---|---|---|---|
| 4,128,735 | A | 12/1978 | Zehren | |
| 4,193,657 | A * | 3/1980 | Slone | E21B 17/028 439/598 |
| 4,536,138 | A | 8/1985 | Romand-Monnier et al. | |
| 7,666,013 | B1 | 2/2010 | Kopecky et al. | |
| 7,980,873 | B2 * | 7/2011 | Emerson | E21B 43/128 174/84 R |
| 2006/0250754 | A1 | 11/2006 | Schlosser | |
| 2010/0167582 | A1 | 7/2010 | Watson | |
| 2014/0042835 | A1 | 2/2014 | Holzmueller et al. | |

OTHER PUBLICATIONS

International Search Report and Written Opinion for related (IS14.8489WOPCT) PCT Application Serial No. PCT/US2015/044966, dated Oct. 28, 2015, 8 pages.

* cited by examiner

*Primary Examiner* — Xuong M Chung Trans

(57) ABSTRACT

A technique facilitates forming couplings along a power cable used, for example, to supply power to an electric submersible pumping system. In coupling the power cable to the electric submersible pumping system, a pothead may be provided with individual pothead bodies connected to individual conductors of the power cable. The pothead bodies are held with respect to each other by a plate structure which may be readily secured to a submersible motor of the electric submersible pumping system. If splices are formed along the power cable, individual potheads may be secured to conductor ends of the sections of power cable. The conductor ends are then inserted into corresponding individual adapters in a manner forming a secure and sealed connection.

20 Claims, 6 Drawing Sheets

SYSTEM AND METHODOLOGY FOR POWER CABLE COUPLING

BACKGROUND

In many hydrocarbon well applications, electric submersible pumping (ESP) systems are used for pumping fluids, e.g. hydrocarbon-based fluids. For example, the ESP system may be conveyed downhole on a well string and used to pump oil from a downhole wellbore location to a surface collection location along a fluid flow path. The ESP system is supplied with AC electrical power from the surface via a power cable routed downhole along the well string. The power cable is coupled with a submersible motor of the ESP system via a connector sometimes referred to as a pothead. The pothead may be coupled to a motor lead extension (MLE) which is part of the overall power cable used to supply electrical power to the ESP system. Coupling existing pothead structures to the submersible motor can be difficult, and existing potheads are sometimes susceptible to leakage.

Additionally power cable couplings may be formed between, for example, sections of the power cable and/or between the MLE and the upper portion of the overall power cable. Such couplings also may be difficult, e.g. time-consuming, and sometimes susceptible to leakage. In deep well applications, sections of power cable may be spliced together to provide a power cable long enough to extend downhole to the ESP system. The splices/couplings are formed at the surface, e.g. on the rig, and splicing difficulty can increase the time and expense associated with the deployment of the well string, including the ESP system.

SUMMARY

In general, a system and methodology facilitate couplings along a power cable used, for example, to supply power to an electric submersible pumping system. In coupling the power cable to the electric submersible pumping system, a pothead may be provided with individual pothead bodies connected to individual conductors of the power cable. The pothead bodies are held with respect to each other by a plate structure which may be readily secured to a submersible motor of the electric submersible pumping system. If splices are formed along the power cable, individual potheads may be secured to conductor ends of the sections of power cable. The conductor ends are then inserted into corresponding individual adapters in a manner forming a secure and sealed cable splice connection.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate use of power cables. The system and methodology provide couplings which can be easier to assemble and use while providing improved protection against leakage. Embodiments of the coupling systems are useful in harsh environments, e.g. downhole environments in which a power cable is used to power an electric submersible pumping system.

In coupling the power cable to the electric submersible pumping system, embodiments described herein utilize a pothead provided with individual pothead bodies connected to individual conductors of the power cable. The pothead bodies are held with respect to each other by a plate structure which may be readily secured to a submersible motor of the electric submersible pumping system. If splices are formed along the power cable, individual potheads may be secured to conductor ends of the sections of power cable. The individual potheads are then inserted into corresponding adapters in a manner forming a secure and sealed connection which provides protection against the harsh, surrounding wellbore environment.

Electric submersible pumping systems may be used in many applications, e.g. wellbore applications, for pumping fluids, such as petroleum and other production fluids. The submersible pumping system utilizes a power delivery system for transmitting power from the surface to an electric submersible motor of the electric submersible pumping system. In some applications, the power delivery system comprises a power cable having an upper power cable portion, a motor lead extension (MLE) which extends from the upper power cable portion to the submersible motor, and a connector which may be referred to as a pothead.

The coupling mechanisms described herein simplify power cable connections, including splices, and reduce the time involved in making the connections. For example, the ability to make rapid connections in wellbore applications can reduce expensive rig time. The coupling/splicing techniques also provide high-quality connections which are dependable in hostile environments, e.g. wellbore environments.

Figure 1:
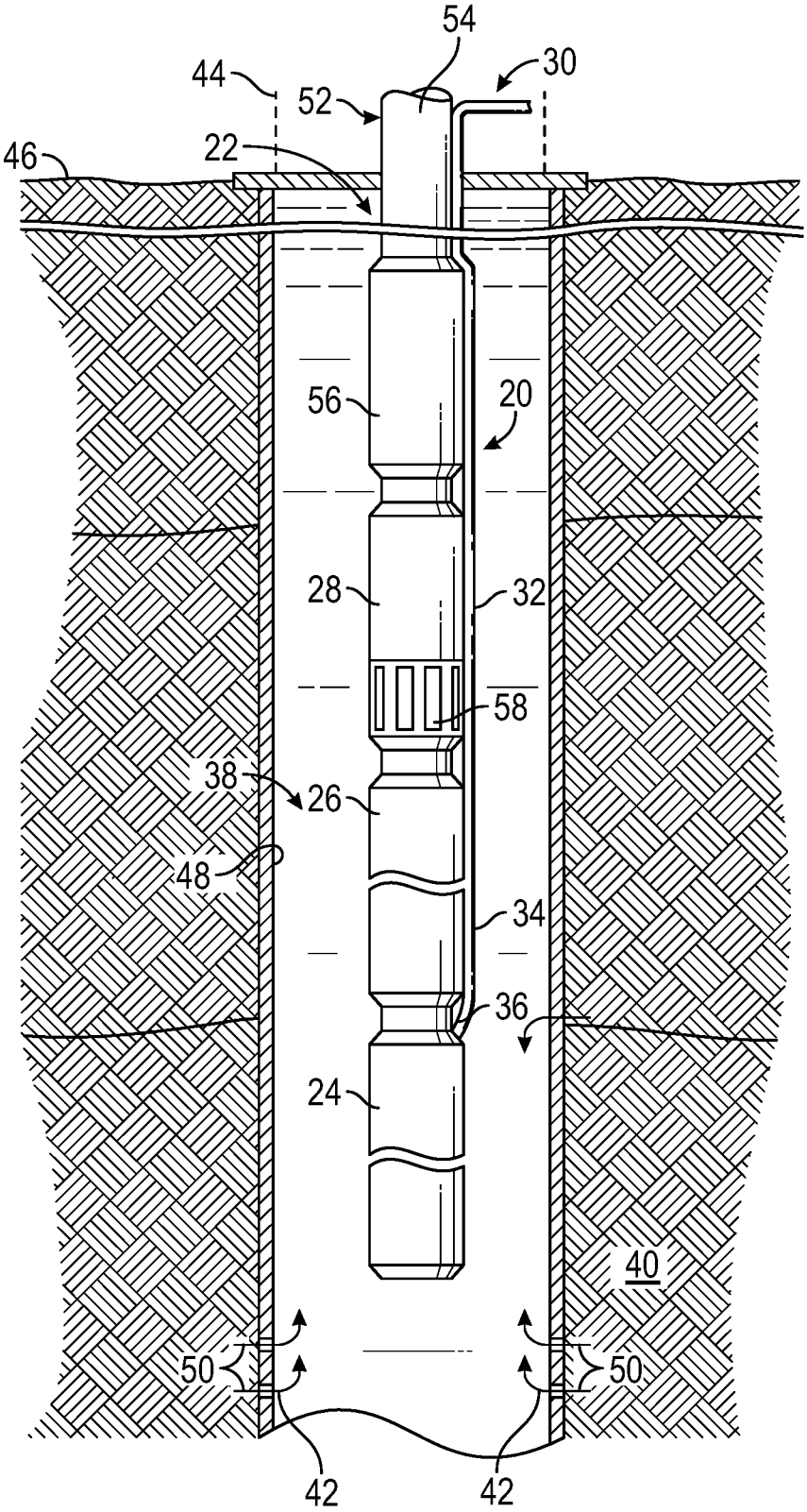
FIG. 1 is a schematic illustration of a well system comprising an example of an electric submersible pumping system positioned in a borehole, e.g. a wellbore, and supplied with power via a power cable, according to an embodiment of the disclosure.

Referring generally to FIG. 1, an example of an electric submersible pumping system 20 is illustrated as deployed along a well string 22. The submersible pumping system 20 may comprise a variety of components depending on the particular well application and/or environment in which it is used. For example, electric submersible pump system may comprise a submersible motor 24, a motor protector 26, and a submersible pump 28 powered by the submersible motor 24. The motor protector 26 enables pressure balancing of the internal motor fluid of submersible motor 24 with respect to the surrounding environment. Electric power is provided to the electric submersible pumping system 20 via a power cable 30. In some embodiments, the power cable 30 may comprise an upper power cable portion 32 coupled with a motor lead extension 34 which, in turn, is coupled with submersible motor 24 via a pothead 36.

The electric submersible pumping system 20 may be deployed into a borehole 38, e.g. wellbore, via well string 22. The wellbore 38 is drilled into a geologic formation 40 containing, for example, desirable production fluids 42 such as hydrocarbon-based fluids. In this embodiment, the wellbore 38 extends downwardly from a wellhead 44 positioned at a surface location 46. In some applications, the wellbore 38 may be lined with a wellbore casing 48 which may be perforated with a plurality of perforations 50 extending through the casing 48 and into the surrounding formation 40. The perforations 50 enable flow of fluids 42 between the surrounding formation 40 and the wellbore 38.

The submersible pumping system 20 may be deployed downhole into wellbore 38 via a conveyance 52 which is part of the well string 22. The conveyance 52 may have a variety of configurations and may comprise a tubing 54, e.g. coiled tubing or production tubing. However, other suitable conveyances, such as wireline or slick line, also may be used to deploy submersible pumping system 20. The conveyance 52 is coupled with submersible pumping system 20 by an appropriate connector 56.

Electric power is provided to submersible motor 24 via the power cable 30 which may be routed downwardly along conveyance 52 and secured thereto. The submersible motor 24, in turn, powers submersible, centrifugal pump 28 which then draws in fluid 42 from wellbore 38 through a pump intake 58. By way of example, the submersible motor 24 may power a centrifugal style pump 28 via a shaft used to rotate at least one impeller and often a plurality of impellers within the pump. The fluid discharged from the submersible pump 28 may be directed along tubing 54 (or along another suitable production flow path) to a desired location, such as a collection location at surface 46. However, various other components and system configurations may be utilized in a variety of pumping operations and environments.

Figure 2:
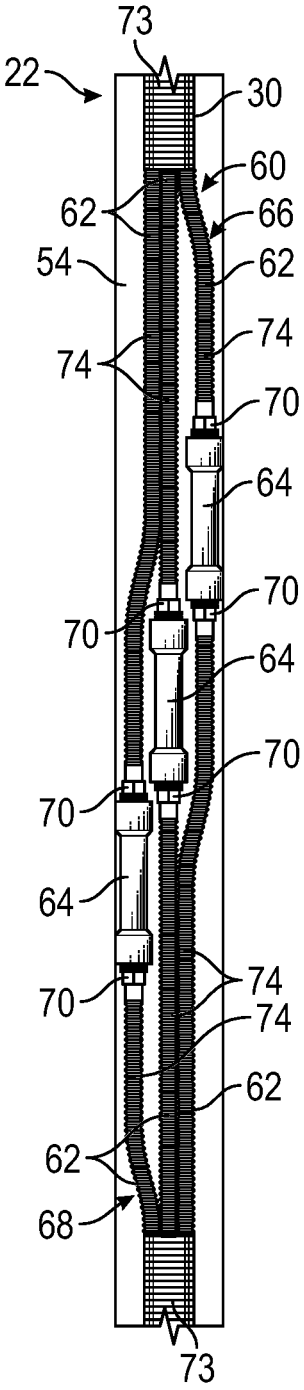
FIG. 2 is a side view of an example of a portion of a power cable deployed along a well string, according to an embodiment of the disclosure.

The power cable 30 may utilize various types of connections to facilitate a more rapid and dependable coupling of the power cable 30 to the submersible motor 24 and/or to facilitate splicing between sections of the power cable. For example, an upper portion of the power cable 30 may be spliced to a lower cable portion or to the motor lead extension 34. Referring generally to FIG. 2, an embodiment of a power cable connection 60 is illustrated. In this example, the power cable 30 is a three-phase power cable having three phases 62 which are independently coupled by a plurality of adapters 64. For example, an upper portion 66 of power cable 30 has three phases 62 which are coupled with a lower portion 68 of power cable 30 which has three corresponding phases 62. The illustrated example shows a flat-type power cable 30, but power cable 30 may be a round-type power cable 30 or other suitable configuration.

Referring again to FIG. 2, an individual connector or pothead 70 is coupled to each phase 62 of each section 66, 68 of power cable 30. In some applications, the individual potheads 70 may be coupled to their corresponding phases 62 at a manufacturing location prior to shipment to the well site. At the well site, the potheads 70 may simply be plugged into their corresponding adapters 64 to form the conductive splice.

Figure 3:
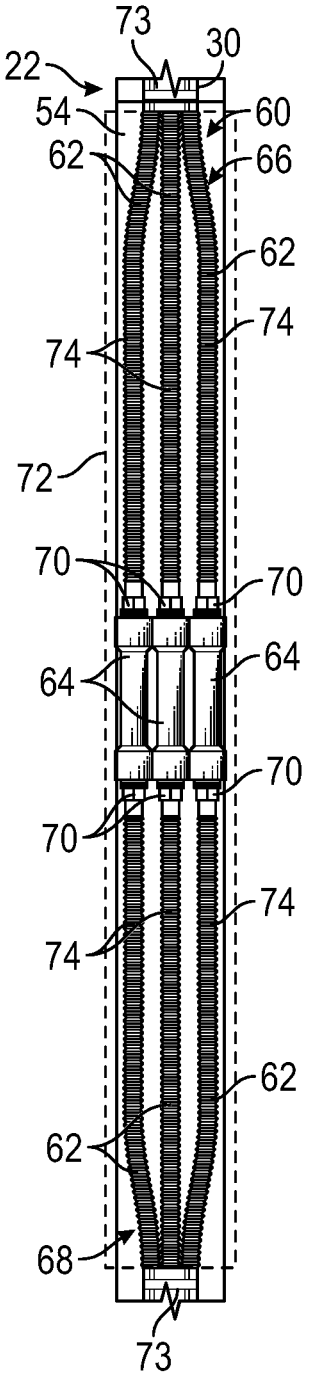
FIG. 3 is a side view of an example of a portion of another power cable deployed along the well string, according to an embodiment of the disclosure.

The sections of power cable 30 may then be banded or otherwise secured to tubing 54 of well string 22 as the well string 22 is continually run downhole into the wellbore 38. In some embodiments, the adapters 64 may be mounted in a staggered configuration along tubing 54, as illustrated in FIG. 2. However, the adapters 64 also may be mounted in a parallel configuration as illustrated in the embodiment of FIG. 3. In some applications, a protective cover 72 may be mounted over adapters 64, as indicated by the dashed lines in FIG. 3.

In an operational example, the individual potheads 70 are preassembled to the corresponding phases 62 by unwrapping an outer armor 73 surrounding the power cable 30. Subsequently, short pieces of individual armor tubing 74 may be slid onto the conductor of each phase 62. The pothead 70 may then be attached to the conductive end of each phase 62 and tested for quality assurance purposes.

Figure 4:
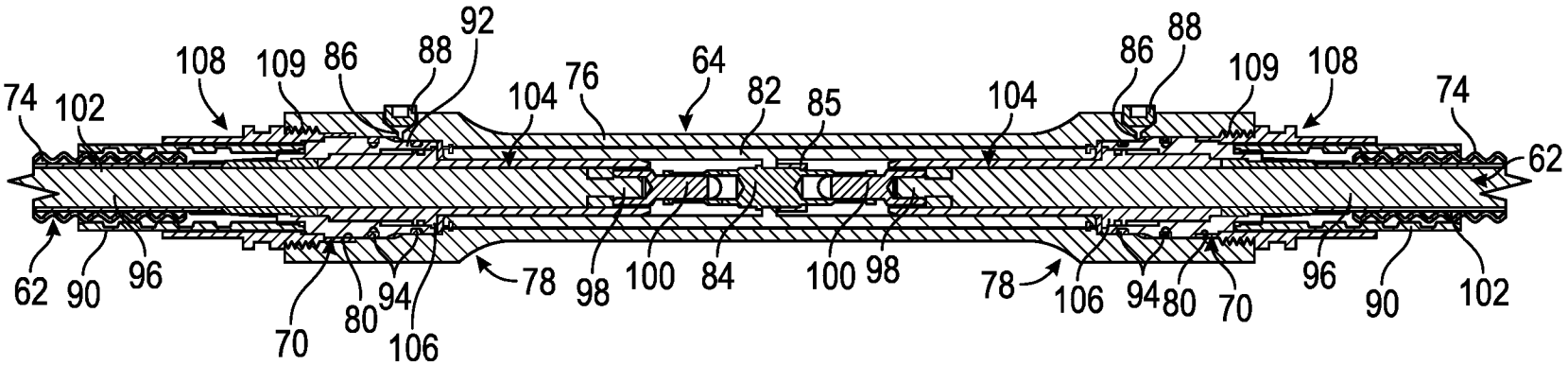
FIG. 4 is a cross-sectional view of an example of a power cable splice utilizing an adapter, according to an embodiment of the disclosure.

Referring generally to FIG. 4, an embodiment of two potheads 70 coupled to a corresponding adapter 64 is illustrated. In this example, adapter 64 comprises an outer casing or housing 76 having housing ends 78 on opposed ends of the adapter 64. The housing ends 78 each have an interior 80 into which corresponding individual potheads 70 may be inserted as described in greater detail below. The illustrated adapter 64 further comprises an interior insulator 82 within which a coupler 84, e.g. a female coupler, is disposed to ensure electrically conductive engagement of the phases 62 from each side of the adapter 64. The coupler 84 may be held in place within insulator 82 by a nut 85 or other suitable fastener. Or, the coupler 84 may be molded into insulator 82. In some embodiments, the adapter 64 may further comprise test ports 86 disposed laterally through housing 76 to enable, for example, pressure testing. The test port 86 may be plugged by, for example, plugs 88, e.g. plug screws.

Although the individual potheads 70 can be constructed at the well site, the individual potheads 70 also may be pre-formed and coupled to the ends of phases 62 at a factory to facilitate rapid splicing at the well site. In the example illustrated, each individual pothead 70 comprises an insulator material 90 which may be molded or otherwise formed over the end of armor tubing 74. The insulator 90 joins an engagement housing 92 having a seal or a plurality of seals 94, e.g. O-ring seals. However, the seals 94 may comprise lip-seals, conical seals, metal-to-metal seals, or other suitable seals. In some embodiments, the corresponding test port 86 extends to a location between a pair of the seals 94 to enable pressure testing of the seals 94. The housing 92 and seals 94 are sized for insertion into and sealing engagement with the interior 80 of the corresponding adapter housing end 78.

In the embodiment illustrated, each phase 62 is enabled by an internal conductor 96 routed through an interior of armor tubing 74 and through an interior of the corresponding pothead 70 such that a terminal end 98 of the conductor 96 may be inserted into adapter 64 and into electrically conductive engagement with coupler 84. In some embodiments, the terminal end 98 may comprise or may be joined with a terminal tip coupler 100 sized and configured to conductively engage the coupler 84 of adapter 64.

Depending on the application, various types of insulative layers 102 may be positioned between conductor 96 and the surrounding armor tubing 74. Additionally, an insulator sleeve 104 may be positioned around at least a portion of the terminal end 98 such that the insulator sleeve 104 extends into an interior of engagement housing 92. An abutment ring 106 may be located between an appropriate shoulder of the insulator sleeve 104 and the adapter insulator 82 so as to properly position each terminal end 98 for engagement with adapter coupler 84 when potheads 70 are inserted into adapter 64. Remaining cavities within adapter 64 may be filled with dielectric oil or grease to eliminate partial discharge. In some applications, a safety valve or other mechanism may be added to the adapter 64 to enable adjustment of the pressure balance across the adapter housing 76.

Suitable fastening mechanisms may be used to secure each pothead 70 in engagement with adapter 64. For example, a retention nut 108 may be positioned about insulator 90 and sized to engage a corresponding shoulder of engagement housing 92. The retention nut 108 also may comprise a threaded engagement region 109 which is threaded onto corresponding threads positioned in the corresponding housing end 78. This enables threading of nut 108 until seals 94 are securely sealed against the interior of the adapter 64 and until the conductor terminal end 98/terminal coupler 100 is securely and conductively engaged with adapter coupler 84. It should be noted that retention nut 108 may have a variety of forms and a variety of engagement mechanisms for selectively securing each pothead 70 to the adapter 64. During a splicing operation, each pothead 70 may simply be plugged into the adapter 64 and secured thereto via the corresponding retention nut 108.

Figure 5:
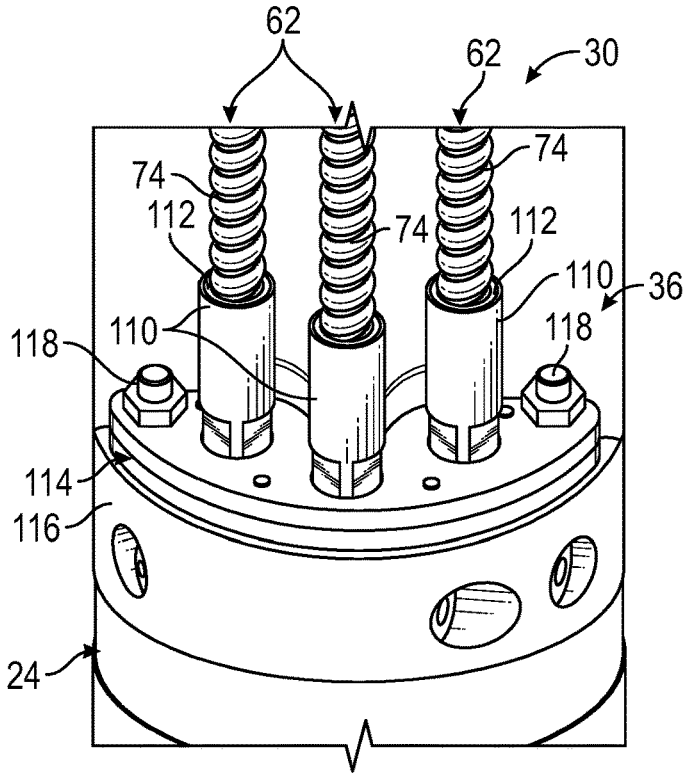
FIG. 5 is an illustration of an example of a pothead for coupling a power cable to a powered device, according to an embodiment of the disclosure.

Referring generally to FIG. 5, an example of connector 36 for coupling the overall power cable 30, e.g. motor lead extension 34, to the powered device, e.g. submersible motor 24, is illustrated. In this example, the connector 36 may be referred to as the power cable pothead and is used to provide a sealed, electrically conductive coupling between the power cable 30 and the submersible motor 24 or other electrically powered device.

As illustrated in FIG. 5, the outer armor layer 73 may once again be removed to expose the individual phases 62 and each of those phases 62 may be covered with individual armor tubing 74. Each phase 62 and corresponding individual armor tubing 74 extends into a pothead body 110. Each pothead body 110 may be combined with an internal stabilizer 112 to stabilize and/or insulate the corresponding conductor 96. By way of example, the internal stabilizer 112 may comprise or may be combined with a material, e.g. an epoxy material, to provide mechanical stabilization of the conductor 96 inside the pothead body 110. In some applications, the stabilizers 112 may be combined with various resins, epoxy materials, or other suitable insulating materials to form a sealed joining of the armor tubing 74 and the pothead body 110.

The pothead bodies 110, e.g. three pothead bodies, are captured in a plate structure 114 and secured at predetermined positions with respect to each other so as to facilitate engagement with the powered device, e.g. submersible motor 24. The plate structure 114 may be secured to an outer housing 116 of submersible motor 24 by suitable fasteners 118, e.g. bolts extending through the plate structure 114 for threaded engagement with housing 116. In some embodiments, seals or a sealing material may be positioned between the plate structure 14 and the corresponding engagement surface of outer housing 116.

Figure 6:
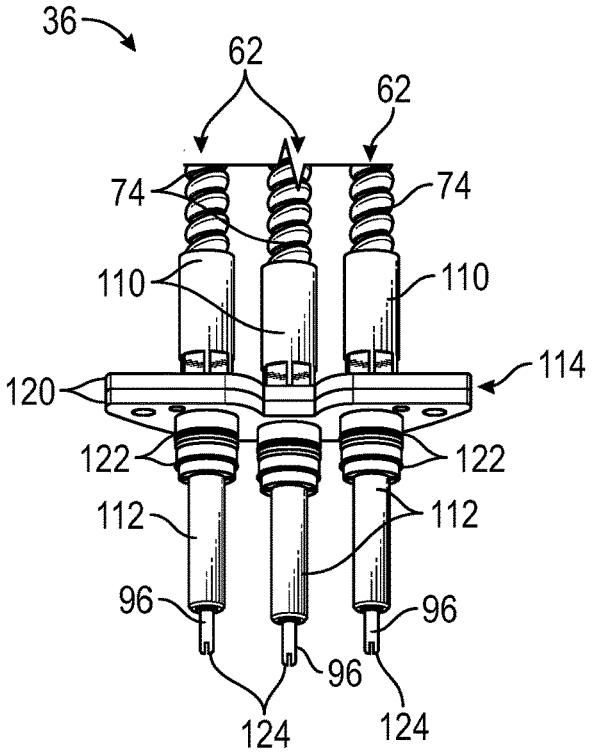
FIG. 6 is an orthogonal view of the pothead illustrated in FIG. 5 but prior to engagement with the powered device, according to an embodiment of the disclosure.

With additional reference to FIG. 6, the plate structure 114 may comprise a plurality of plates 120, e.g. two plates, configured to securely hold the pothead bodies 110. In the example illustrated, the pothead bodies 110 extend through the plate structure 114 and comprise a seal or a plurality of seals 122, e.g. O-ring seals, positioned to form a sealing engagement with corresponding receptacles in outer housing 116 of submersible motor 24. Depending on the application, the insulators 112 may be sized to extend from the pothead bodies 110. Additionally, terminal ends 124 of the individual conductors 96 extend from the corresponding insulators 112 for electrically conductive engagement with the submersible motor 24 or other powered device.

Figure 7:
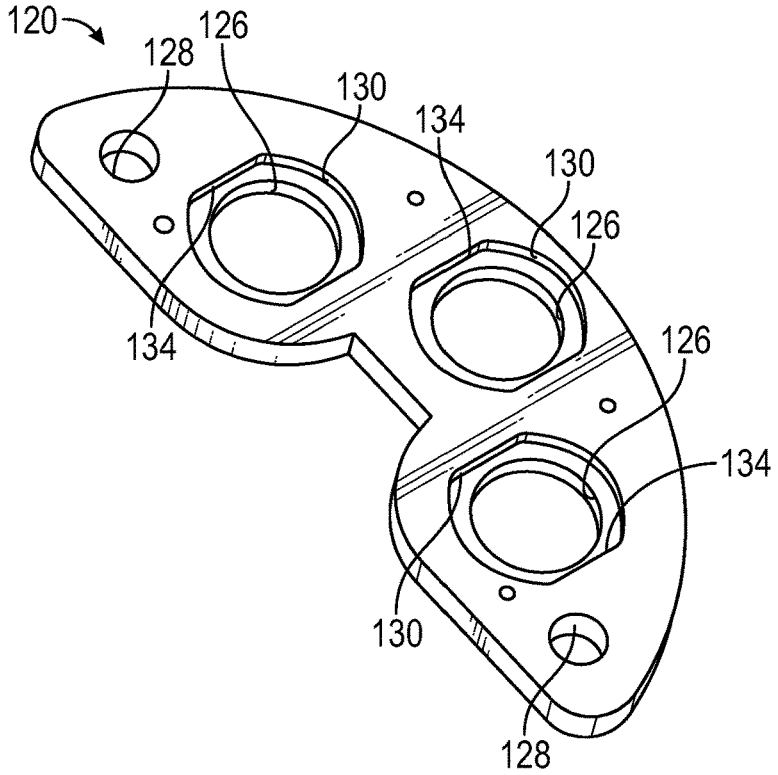
FIG. 7 is an orthogonal view of an example of a plate which forms part of the plate structure used to attach the pothead to the powered device, according to an embodiment of the disclosure.
Figure 8:
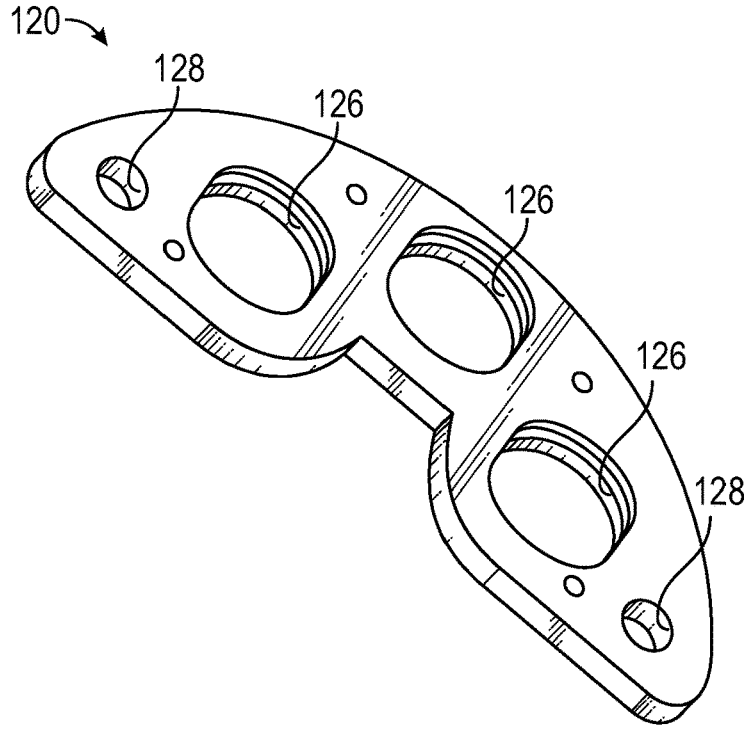
FIG. 8 is an orthogonal view of an example of another plate which forms part of the plate structure used to attach the pothead to the powered device, according to an embodiment of the disclosure.

Referring generally to FIGS. 7 and 8, embodiments of the upper plate 120 and the lower plate 120 are illustrated, respectively. The plates 120 may have a variety of configurations to accommodate different types of pothead bodies 110 as well as different spacings. In the example illustrated, the upper plate 120 illustrated in FIG. 7 has a plurality of openings 126 sized to receive corresponding pothead bodies 110. The upper plate 120 also comprises fastener openings 128 positioned to receive fasteners 118 therethrough. Similarly, the lower plate 120 illustrated in FIG. 8 has a corresponding arrangement of openings 126 and fastener openings 128.

Figure 9:
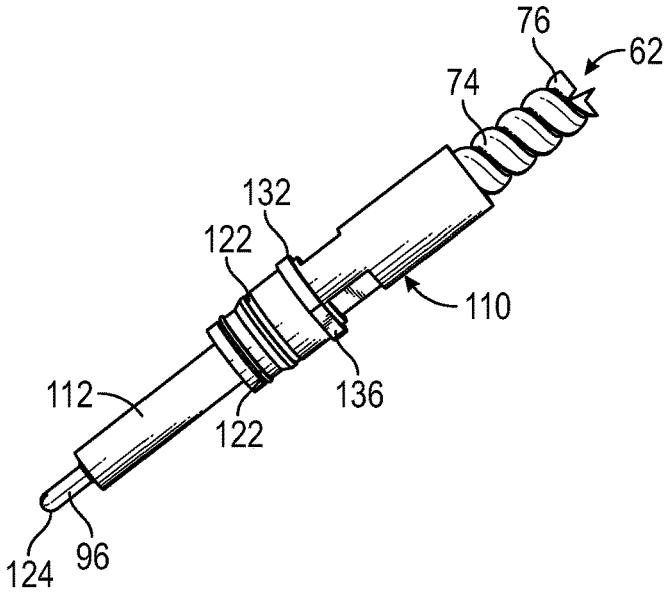
FIG. 9 is an orthogonal view of an example of one of the pothead bodies used to construct the overall pothead for coupling the power cable to the powered device, according to an embodiment of the disclosure.

In some embodiments, at least one of the plates 120 comprises a plurality of recessed regions 130, each of which extends outwardly from its corresponding opening 126. Each recessed region 130 is configured to receive a mounting feature 132, e.g. a flange, of the corresponding pothead body 110 (see FIG. 9). The mounting feature 132 is illustrated as a flange but it may comprise other configurations, e.g. pins or protrusions. Additionally, an anti-rotation feature may be utilized to prevent rotation of the pothead bodies 110 with respect to the plate structure 114. According to an example, the anti-rotation feature may comprise at least one flat side 134, e.g. two flat sides, located along each recessed region 130 and a corresponding flat side 136 positioned along flange 132. When the flange 132 of a given pothead 110 is received in the corresponding recessed region 130, the flat side 134 and corresponding flange flat side 136 are aligned to prevent rotation of the pothead 110 with respect to the plate 120. In some embodiments, the upper and lower plates 120 may both comprise recessed regions 130 and flat side(s) 134.

Figure 10:
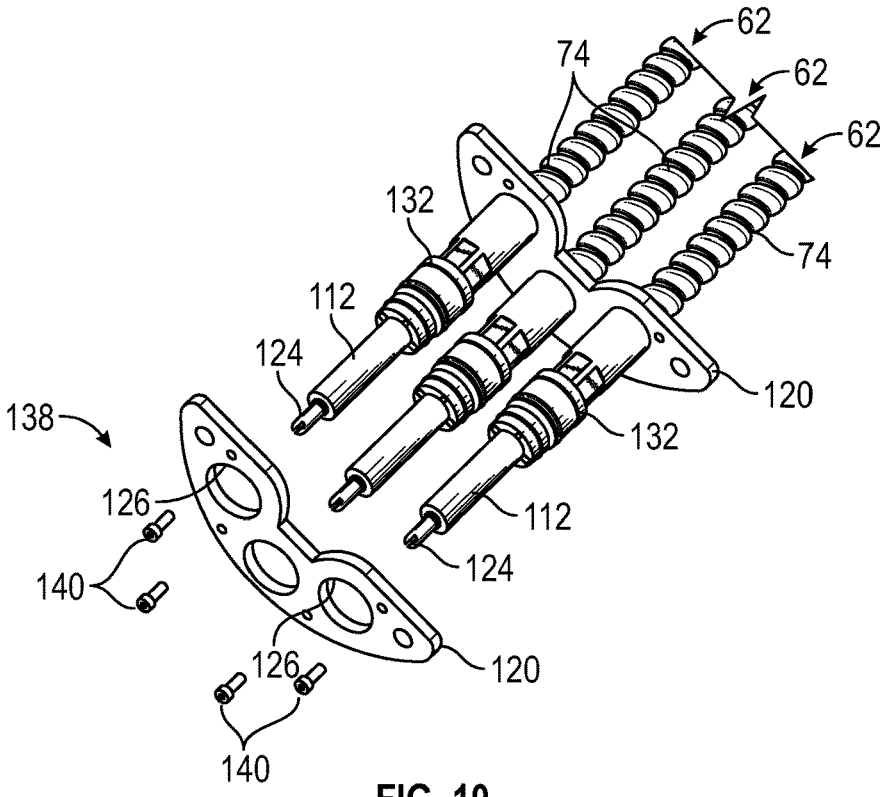
FIG. 10 is an exploded view showing assembly of an example of the plate structure used to secure the pothead to the powered device, according to an embodiment of the disclosure.

The overall pothead assembly 36 may be assembled by placing the upper plate 120 over the three pothead bodies 110 with its recessed regions 130 oriented downwardly to engage the flanges 132, as illustrated in FIG. 10. The lower plate 120 may be slid upwardly over the engagement ends of the pothead bodies 110 on an opposite side of flanges 132 to be joined with the upper plate 120, thus capturing flanges 132 therebetween. In some embodiments, the lower plate 120 also comprises the appropriately configured recessed regions 130 which engage flanges 132 from a lower side. The anti-rotation feature, e.g. flat sides 134, 136, prevent rotation of the pothead bodies 110 with respect to the plate structure 114. It should be noted the terms "upper" and "lower" as well as the term "downwardly" are provided as terms of reference with respect to the figures but should not be construed as limiting with respect to the position of the plates 120 during assembly or use.

After the plates 120 are positioned over the pothead bodies 110, the plates may be secured to each other by a fastening mechanism 138. By way of example, the fastening mechanism 138 may comprise a plurality of threaded fasteners 140 which extend through one of the plates 120 for threaded engagement with the adjacent plate 120. However, other fastening mechanisms 138, e.g. welds, adhesives, or other suitable mechanisms, may be used to secure plates 120 to each other during construction of plate structure 114. Once plate structure 114 is formed, the potheads 110 are securely held in place and the individual phases 62 are thus positioned for conductive engagement with submersible motor 24 or other electrically powered device.

According to some embodiments, the pothead 36 may be preassembled to motor lead extension 34 in a factory. In such an embodiment, the three pothead bodies 110 may be installed between plates 120 and fixed into the combined plate structure 114. Other motor lead extension components may then be installed, e.g. coupled, to the pothead 36 sequentially. The sequencing ensures the three phases of the motor lead extension are continually kept at the same length (including during installation to the submersible motor 24), thus eliminating potential stresses associated with differences in length between the three legs of the motor lead extension.

Depending on the parameters of a given application and/or environment, the structure of electric submersible pumping system 20 may be adjusted. For example, the submersible pumping system 20 may be combined with other components for use in a wellbore or other type of borehole. Similarly, the components of the adapter 64 and individual potheads 70 may be adjusted to accommodate a specific application and/or environment. Similarly, the components of the overall pothead 36 may be adjusted according to the parameters of the specific application and/or environment. For example, the materials used to form the components or the configuration of specific components may be changed.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for splicing power cable, comprising:

a first section of power cable having:

a first conductor terminating at a first terminal end;

a first individual armor layer disposed around the first conductor; and a first pothead sealed to the first individual armor layer;

a second section of power cable having:

a second conductor terminating at a second terminal end;

a second individual armor layer disposed around the second conductor; and a second pothead sealed to the second individual armor layer;

an adapter comprising a first open end, a second open end, and an internal coupler, the internal coupler configured to receive the first terminal end and the second terminal end in an electrically conductive engagement axially between the first terminal end and the second terminal end when the first pothead and the second pothead are inserted into the first open end and the second open end, respectively; and a fastening system comprising threaded fasteners configured to hold the first pothead and the second pothead in sealing engagement with the adapter within the first open end and the second open end, respectively.

2. The system as recited in claim 1, wherein the first and second sections of the power cable each have three conductors for carrying three-phase power.

3. The system as recited in claim 2, wherein the three conductors of the first section of power cable and the three conductors of the second section of power cable are connected by three adapters.

4. The system as recited in claim 3, wherein the second section of power cable comprises a motor lead extension.

5. The system as recited in claim 4, wherein the motor lead extension is connected to a submersible motor of an electric submersible pumping system.

6. The system as recited in claim 5, wherein the three adapters are mounted along a tubing string in a staggered arrangement.

7. The system as recited in claim 5, where the three adapters are mounted along a tubing string in a parallel arrangement.

8. The system as recited in claim 1, wherein the first pothead and the second pothead each have a housing with a plurality of seals oriented to seal against an interior of the adapter.

9. The system as recited in claim 8, wherein the adapter comprises a plurality of test ports for testing the plurality of seals associated with the housings.

10. A system for coupling a power cable, comprising:

a power cable having a plurality of conductors for carrying three-phase power to a powered device; and a pothead connector having:

a plurality of pothead bodies configured to be coupled with the plurality of conductors, each of the plurality of pothead bodies having a mounting feature;

a first plate having a plurality of first plate openings to accommodate the plurality of conductors therethrough, the first plate being positioned to engage the mounting feature of each of the plurality of pothead bodies;

a second plate having a plurality of second plate openings to accommodate the plurality of conductors therethrough, the second plate being positioned on an opposite side of the mounting feature of each of the plurality of pothead bodies relative to the first plate to secure at least a portion of the mounting feature of each of the plurality of pothead bodies between the first plate and the second plate; and a fastening mechanism to fasten the second plate to the first plate.

11. The system as recited in claim 10, wherein the plurality of conductors comprises three conductors.

12. The system as recited in claim 11, wherein the three conductors terminate at terminal ends oriented to plug into the powered device.

13. The system as recited in claim 12, wherein the fastening mechanism comprises threaded fasteners for securing together the first plate and the second plate.

14. The system as recited in claim 12, wherein the mounting feature of each of the plurality of pothead bodies comprises a flange.

15. The system as recited in claim 12, wherein each mounting feature comprises a flange that has at least one flat side, and wherein at least one of the first plate and the second plate has corresponding recesses for receiving the flanges.

16. The system as recited in claim 12, further comprising the powered device in the form of a submersible motor of an electric submersible pumping system.

17. A method, comprising:

providing a pothead with three individual pothead bodies coupled to three conductors of a power cable, the three conductors having terminal ends;

holding the three individual pothead bodies at a desired position with respect to each other by a plate structure having a plurality of plates which grip mounting features of the three individual pothead bodies between at least two of the plurality of plates;

plugging the terminal ends into a submersible motor of an electric submersible pumping system to form a seal between the individual pothead bodies and the submersible motor; and fastening the plate structure to the submersible motor via a plurality of threaded fasteners.

18. The method as recited in claim 17, further comprising forming a splice along the power cable via three individual adapters.

19. The method as recited in claim 18, further comprising coupling individual potheads to conductor ends of sections of the power cable and plugging the individual potheads into corresponding adapters of the three individual adapters.

20. The method as recited in claim 19, further comprising conveying the electric submersible pumping system downhole into a wellbore.

* * * * *